US011387580B2

(12) United States Patent
Fehling et al.

(10) Patent No.: US 11,387,580 B2
(45) Date of Patent: Jul. 12, 2022

(54) SPRING FORCE TERMINAL FOR CONDUCTORS

(71) Applicant: Weidmüller Interface GmbH & Co. KG, Detmold (DE)

(72) Inventors: Stephan Fehling, Lage (DE); Michael Herrmann, Detmold (DE); Walter Hanning, Detmold (DE); Constantin Classen, Detmold (DE)

(73) Assignee: Weidmüller Interface GmbH & Co. KG

( * ) Notice: Subject to any disclaimer, the term of this patent is extended or adjusted under 35 U.S.C. 154(b) by 0 days.

(21) Appl. No.: 16/977,119

(22) PCT Filed: Mar. 6, 2019

(86) PCT No.: PCT/EP2019/055503
§ 371 (c)(1),
(2) Date: Sep. 1, 2020

(87) PCT Pub. No.: WO2019/174982
PCT Pub. Date: Sep. 19, 2019

(65) Prior Publication Data

US 2021/0057830 A1 Feb. 25, 2021

(30) Foreign Application Priority Data

Mar. 13, 2018 (DE) ..... 20 2018 101 402

(51) Int. Cl.
*H01R 4/48* (2006.01)
*H01R 9/24* (2006.01)

(52) U.S. Cl.
CPC ..... *H01R 4/4836* (2013.01); *H01R 9/2408* (2013.01); *H01R 9/2416* (2013.01)

(58) Field of Classification Search
CPC ..... H01R 4/4836; H01R 4/4818
See application file for complete search history.

(56) References Cited

U.S. PATENT DOCUMENTS 7,997,915 B2 8/2011 Pueschner et al.
10,658,766 B2 * 5/2020 Herrmann ..... H01R 4/4836

FOREIGN PATENT DOCUMENTS

DE 3237787 C1 3/1984
DE 202014103797 U1 11/2014
(Continued)

*Primary Examiner* — Ross N Gushi
(74) *Attorney, Agent, or Firm* — Laubscher & Laubscher, P.C.

(57) ABSTRACT

A spring force terminal such as a direct plug-in terminal for connecting a flexible stranded conductor includes a housing having a chamber and a plug-in channel for the conductor into the chamber. A busbar or a clamping cage are provided and a clamping spring arranged in the chamber acts as a compression spring for fixing the electrical conductor on the busbar or the clamping cage in the region of a clamping point. The clamping spring has a clamping leg pivotable around a pivot axis, which is adjustable from a latching state in which it is latched in a latching position into a clamping state in which it is unlatched from the latching position and presses the electrical conductor against the busbar or the clamping cage. The latching state is produced by pressing on the clamping leg in the conductor insertion direction using a pusher wherein the clamping leg is releasable from the latching state using two different actuatable adjustment devices. The second release element is designed to release the pusher from the latching position to release the clamping leg from the latching state. The release element is arranged and formed laterally in relation to the pusher in the chamber in such a way that it acts on the pusher essentially perpendicularly to the conductor insertion direction to release the pusher from the latching position.

3 Claims, 16 Drawing Sheets

(56) References Cited

FOREIGN PATENT DOCUMENTS

| | | | |
|---|---|---|---|
| DE | 102015118574 | A1 | 5/2017 |
| DE | 202017103185 | U1 | 9/2017 |
| DE | 202016104971 | U1 | 12/2017 |
| EP | 2768079 | A1 | 8/2014 |
| EP | 2947718 | A1 | 11/2015 |
| WO | 2017072092 | A1 | 5/2017 |

* cited by examiner a)

b)

a)

c)

d)

SPRING FORCE TERMINAL FOR CONDUCTORS

This application is a § 371 National Stage Entry of International Patent Application No. PCT/EP2019/055503 filed Mar. 6, 2019. Application No. PCT/EP2019/055503 claims priority of DE202018101402.1 filed Mar. 13, 2018.

BACKGROUND OF THE INVENTION

The present invention relates to a spring force terminal.

Such spring force terminals designed as direct plug-in or push-in terminals have a clamping spring designed as a compression spring, which pushes or presses a conductor against a busbar are known. They differ on the basis of their use, for example, depending on the required current carrying capacity of the busbar, the spring force of the clamping spring, and/or their installation conditions, in particular their size. Simple installation and inexpensive production are requirements which are required of such a terminal.

BRIEF DESCRIPTION OF THE PRIOR ART

U.S. Pat. No. 7,997,915 B2 discloses a wire end ferrule, on the end of which a direct plug-in terminal is arranged for non-releasably connecting an electrical conductor. The direct plug-in terminal includes a current-conducting clamping cage for electrically contacting the electrical conductor and a spring for fixing the electrical conductor. The spring has a pivotable clamping leg, which is positioned on a holding edge if an electrical conductor is not inserted into the push-in terminal, so that a free space is kept open for the electrical conductor and it is insertable into the clamping cage. Upon insertion into the direct plug-in terminal, the holding device is displaced so that the clamping leg releases and is pivoted. The pivoted clamping leg presses the electrical conductor on the clamping cage.

A refinement of this direct plug-in terminal is known from EP 2 678 079 A1, in which the latching state is reproducible using an actuating element, and a pressure element, after a release of the latched clamping leg by the conductor.

It is furthermore known from DE 20 2017 103 185 U1 that the clamping leg is releasable from the latching state using two different adjustment devices. The latching state is not produced by latching an element on a free clamping edge of the clamping leg and the latching state is nonetheless releasable by introducing the conductor into the housing in the conductor insertion direction. The first of the two adjustment devices has a movable release element, on which the end of the conductor to be contacted acts during the release of the conductor and the clamping leg of the clamping spring is releasable directly or indirectly from the latching state. The second of the two adjustment devices, in contrast, is an actuating element for directly moving the clamping leg. The actuating element can be latched jointly with the clamping leg of the clamping spring in the latching state and is releasable directly from the latching state, whereby the clamping leg of the clamping spring is also releasable from the latching state. The actuating element is a pusher for moving the clamping leg, which is displaceable in an actuating channel of the housing in the plug-in direction and is movable perpendicular to the plug-in direction in a limited manner and can be latched in the housing on a clamping edge of the housing in the latching state.

The spring force terminal of DE 20 2017 103 185 U1 has proven itself well per se. Nonetheless, its constructive configuration can be further optimized. The solution to this problem is the object of the invention.

SUMMARY OF THE INVENTION

A spring force terminal, and particularly a direct plug-in terminal, is provided for connecting a conductor such as a flexible stranded conductor. The terminal includes a housing having a chamber and a plug-in channel for the conductor in the chamber, a busbar and/or a clamping cage, and a clamping spring which is arranged in the chamber and acts as a compression spring for fixing the electrical conductor on the busbar and/or the clamping cage in the region of a clamping point. The clamping spring has a clamping leg pivotable around a pivot axis which is adjustable from a latching state, in which it is latched in a latched position, into a clamping state, in which it is unlatched from the latching state and presses the electrical conductor against the busbar or the clamping cage. The latching state is produced by pressing on the clamping leg in the conductor insertion direction using a pusher. The clamping leg is releasable from the latching state using two different actuatable adjustment devices. The first adjustment device has a movable release element on which the end of the conductor to be contacted acts during the release of the conductor and the second adjustment device and the clamping leg of the clamping spring are releasable from the latching state. The second adjustment device is the pusher for moving the clamping leg, wherein the pusher is displaceable in an actuating channel of the housing in the insertion direction and is movable to a limited extent perpendicularly to the insertion direction and has a latching edge, on which it can be latched in the housing on a latching edge of the housing in the latching state to hold the clamping spring latched in the open position. The latching edge is releasable from the latching state by opposing movement. The release element is designed to release the pusher from the latching position and to release the clamping leg from the latching state.

The release element is arranged laterally relative to the pusher in the chamber and is designed in such a way that to release the pusher from its latching position, it acts on the pusher perpendicularly or essentially perpendicularly to the conductor insertion direction—i.e., at an angle less than 45°, preferably less than 30°—to the conductor insertion direction. This is because in this way the pusher can easily and reliably be released from the latching state using small forces since the conductor can only exert on the release element under certain circumstances, which also releases the clamping spring from latching.

The release of the open position or the latching position of the clamping leg is possible in two ways as described in the prior art. However, a spring force terminal which is particularly easy to release from the latching state is provided.

For this purpose, the release element acts on at least one actuating contour of the pusher during release of the latching state.

The release element is designed as a tilt lever pivotably mounted in the housing having at least one lever arm and having an axis of rotation, and the pusher also has an axis of rotation.

In a preferred embodiment, an actuating contour is provided on the pusher, which interacts with an actuating counter contour of the release element to clamp an electrical conductor in the spring force terminal and/or to release the electrical conductor from the spring force terminal. The release element preferably rotates from a base position around an axis of rotation into a pivot position. It is particularly preferable that the actuating counter contour is arranged in the base position below the rotating pin of the release element. The spring force terminal is thus produced in a space-saving manner.

According to a further embodiment, the rotational directions of the pusher and the release element during the release of the pusher from the latching state are identical. This feature is advantageous, but not required. A particularly compact configuration of the release element having two release paths by release actuation by the conductor or direct movement of the pusher using a tool from outside the terminal or by hand can be provided.

For good and secure release, the axis of rotation of the pusher is located in the conductor insertion direction before the latching edge and above the clamping leg of the clamping spring, and/or the axis of rotation of the release element is located in the conductor insertion direction before one or more actuating contours of the pusher.

It is preferable that the latching state is not produced by latching an element on a free clamping edge of the clamping leg, and the latching state is releasable by introducing the conductor into the housing in the conductor insertion direction and acting with the conductor on the release element and by action of the release element on the pusher perpendicularly or essentially perpendicularly to the plug-in direction.

Release of the pusher from its latching position and thus the release of the clamping spring from its latching state is designed in a particularly functionally-reliable manner. Thus, the corresponding latching edges of the pusher and the housing are formed as steps, which preferably have rounded edges and/or which have corresponding latching edge faces, which are aligned in the latched state at an angle between 0 and 30°, preferably 5 to 20° in relation to one another. In this way, sliding of the pusher out of the latching is facilitated in each case, without the latching state being able to release itself. Overall, self-inhibiting in the region of the latching edge is thus maintained, which a person skilled in the art can check via experimentation.

The spring force terminal is suitable not only for solid conductors, but also for stranded conductors. This is because the stranded conductor is displaceable back and forth in the free space of the chamber in the housing without splitting open the strands in the latching state. The busbar is formed of a material which has good electrical conductivity, for example, copper or a copper alloy. Spring steel is a preferable material for the clamping spring.

BRIEF DESCRIPTION OF THE FIGURES

Other objects and advantages of the invention will become apparent from a study of the following description when viewed in the light of the accompanying drawing, in which.

DETAILED DESCRIPTION

Figure 1B:
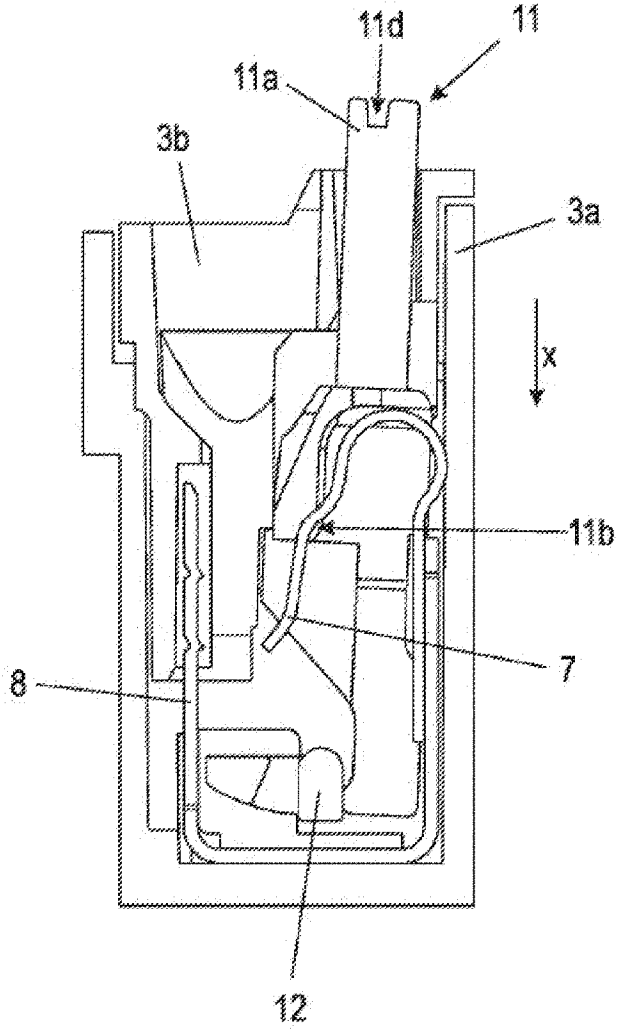
FIG. 1*b* shows the spring force terminal from FIG. 1*a* with the clamping leg in a latching state.

FIGS. 1*a* and 1*b*, FIGS. 2*a* and 2*b*, and FIGS. 3*a*, 3*b*, and 3*c* show a first spring force terminal 1 in various views and switching states. The individual components or assemblies of these components can additionally be observed in FIGS. 4*a*-4*h*, FIGS. 5*a* and 5*b*, and FIG. 6.

The spring force terminal 1 has a housing 3, in which a direct plug-in terminal 2 (also called "push-in terminal") is formed. The housing 3 preferably is formed of an insulating plastic. The housing 3 can be formed in one or multiple parts. Reference is additionally made in this regard to the prior art, in which various designs are described which are also combinable in principle with the present invention. The housing 3 can thus be formed laterally open and it can be designed to be stackable.

The housing 3—see also FIGS. 4*a*, 4*c*, and 4*d*—includes a sleeve-like housing lower part 3*a*, which is essentially rectangular in section, and on which a housing upper part 3*b* can be placed. The housing upper part 3*b* can be fixed, for example, latched, on the housing lower part 3*a* by a friction lock and/or form fit.

A chamber 4 for accommodating functional elements of the direct terminals 2, in particular also including metal parts, is formed in the housing 3. The chamber 4 is formed in the housing lower part 3*a*. The chamber 4 can be formed open on top and possibly also open on the bottom. The chamber 4 is terminated on top by the housing upper part 3*b*.

Figure 9:
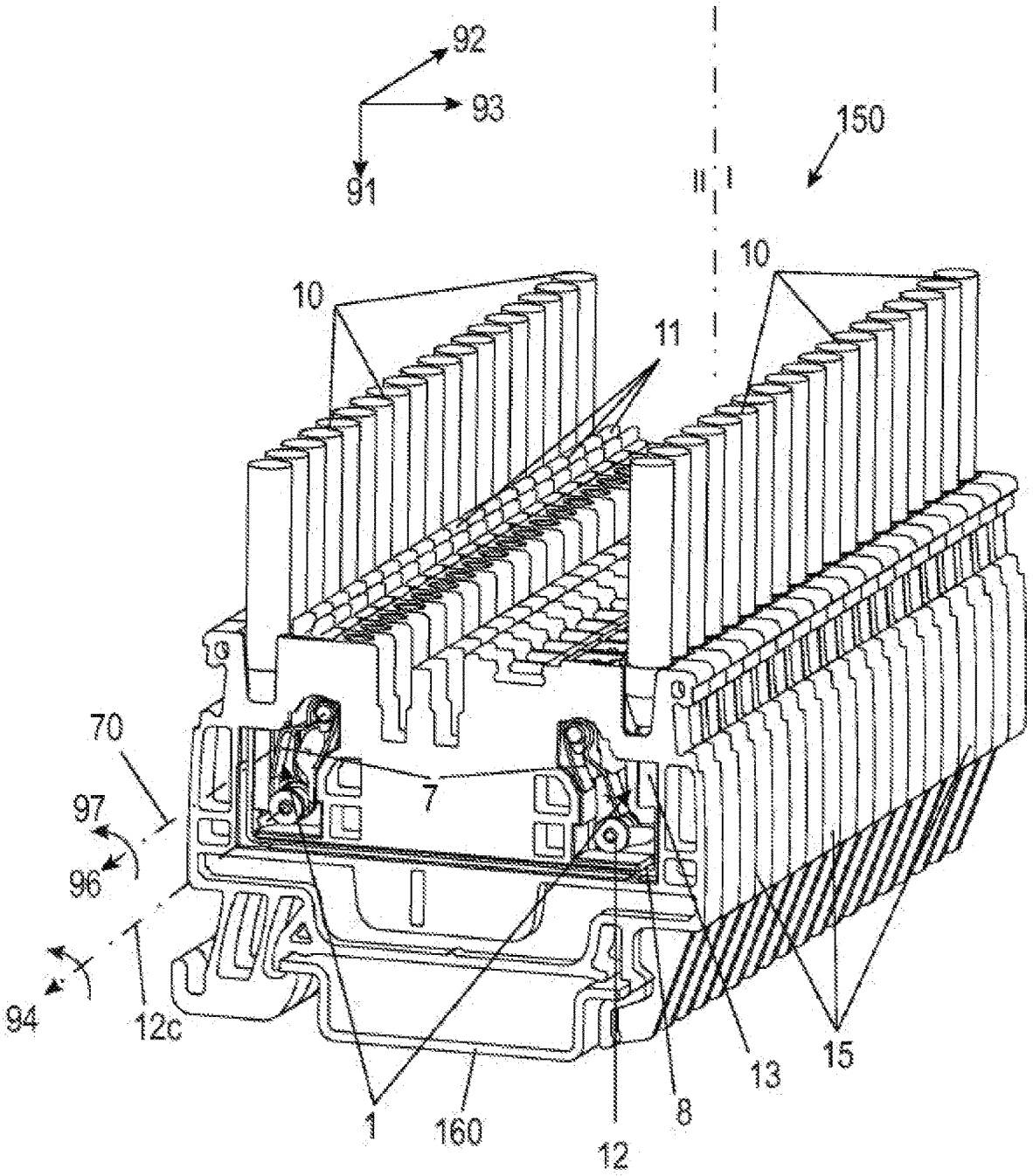
FIG. 9 is a perspective view of a terminal block assembly having a plurality of terminal blocks of FIG. 7 stacked on one another in a stacking direction.

It can be formed closed on the bottom or open in such a way that a terminal for connection to an external electrical assembly can adjoin on the bottom. Reference is made in this regard to FIG. 9. The housing lower part 3*a* can alternatively also have multiple chambers, multiple direct connections 2, and multiple housing upper parts or one housing upper part correspondingly spanning multiple chambers for this purpose (not shown).

The chamber 4 is connected, on the one hand, by a conductor plug-in channel 5 to one of the outer sides of the housing—called the plug-in side, the upper side here—and, on the other hand, by an actuating channel 6. The actuating channel 6 extends essentially in parallel to the conductor plug-in channel 5. The actuating channel 6 can be cylindrical or also stepped and/or conical. The conductor plug-in channel 5 and/or the actuating channel 6 can be formed in the housing upper part 3*b*. The conductor plug-in channel 5 is used for plugging a conductor 10 into the housing in a conductor plug-in direction X. It can have a type of insertion funnel. The conductor 10 has a stripped conductor end. It is used for plugging into the direct plug-in connection 2 as shown in FIGS. 2*a* and 2*b*.

A clamping spring 7 and a busbar 8 are arranged in the chamber 4 to form the direct plug-in connection 2. A clamping cage made of metal can optionally be provided, which can be used to support the clamping spring 7 and/or the busbar 8. However, a clamping cage can also be provided. Reference is again made in this regard to the generic prior art.

Figure 1A:
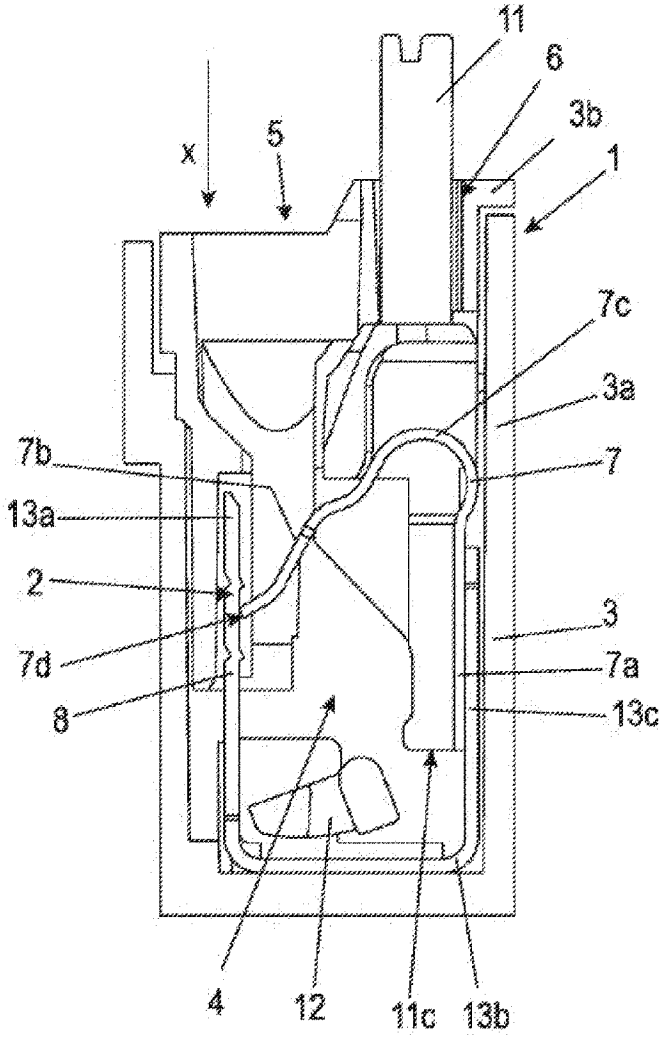
FIG. 1*a* is a sectional view of a spring force terminal having a clamping leg, which is provided for clamping an electrical conductor insertable or inserted into the spring force terminal, in a non-latched state.
Figure 2A:
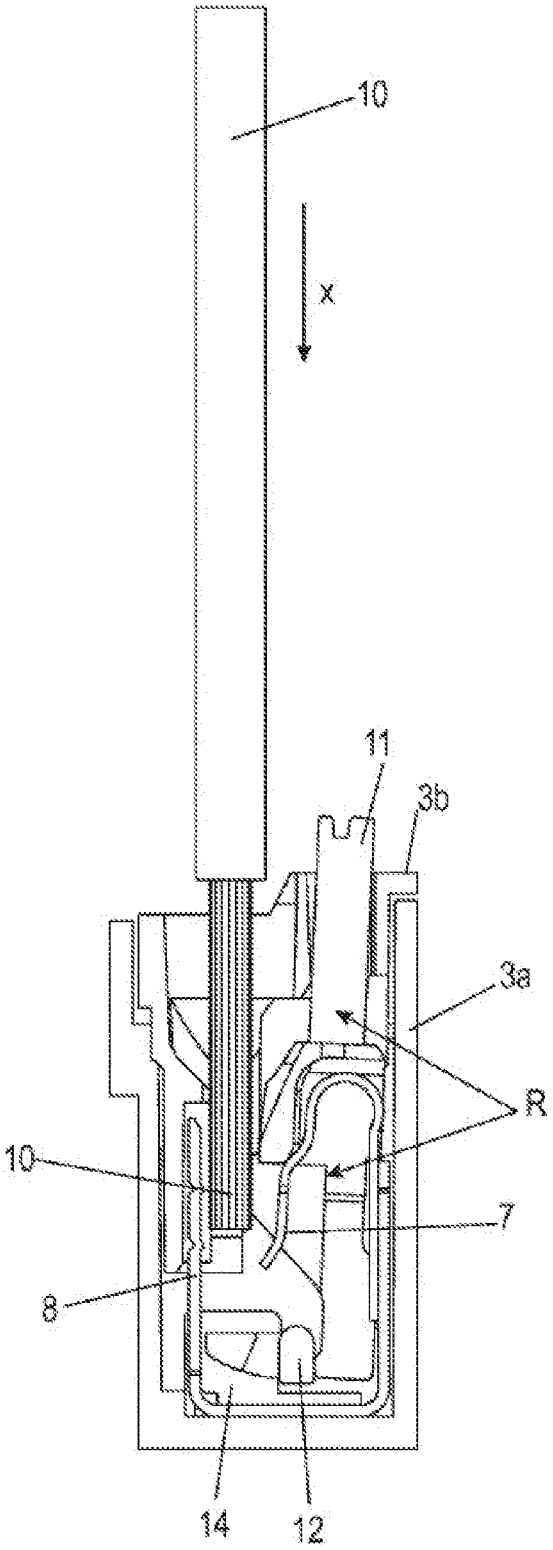
FIG. 2*a* is an interior view of the spring force terminal of FIG. 1*b* having a conductor being inserted into the spring force terminal, wherein the clamping leg is still in the latching state.
Figure 2B:
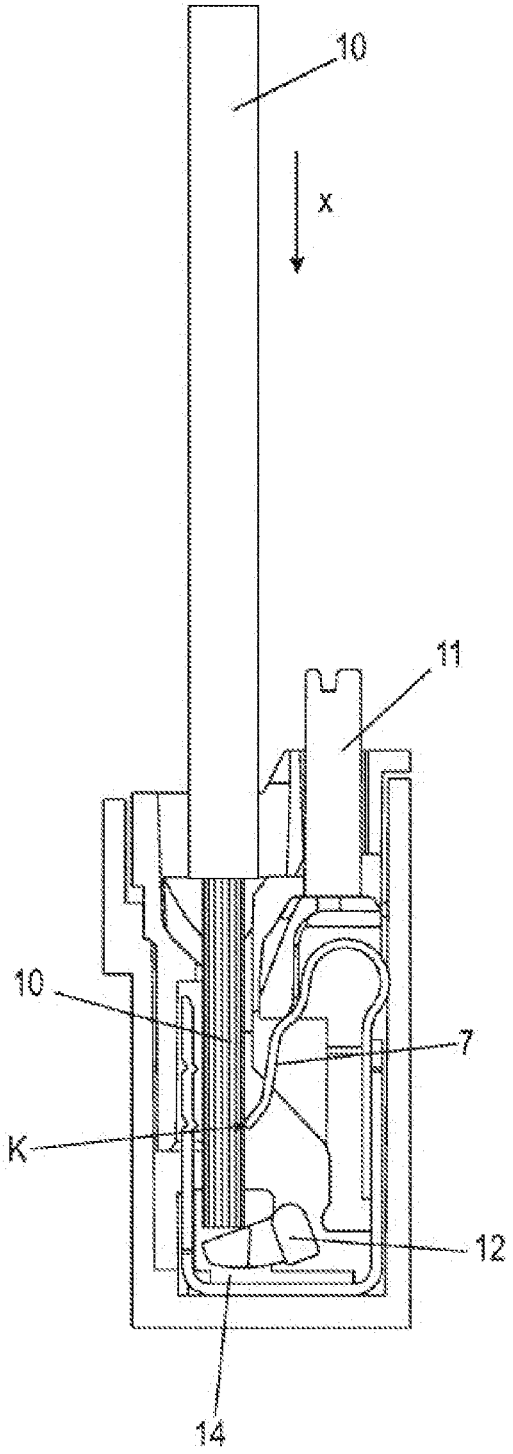
FIG. 2*b* is an interior view of the spring force terminal from FIG. 2*a* having an electrical conductor inserted into the spring force terminal, wherein the clamping leg is unlatched from the latching state.
Figure 3B:
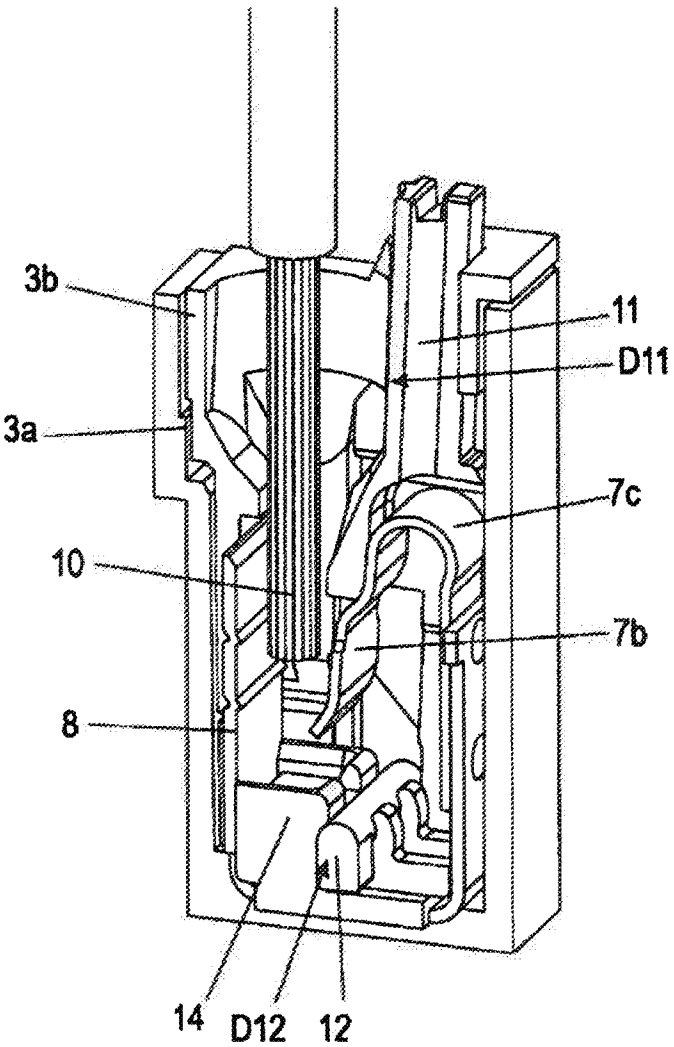
FIG. 3*b* is a perspective interior view of the spring terminal from FIG. 3*a* showing a conductor during insertion into the spring force terminal, wherein the clamping leg is still in a latching state.
Figure 3A:
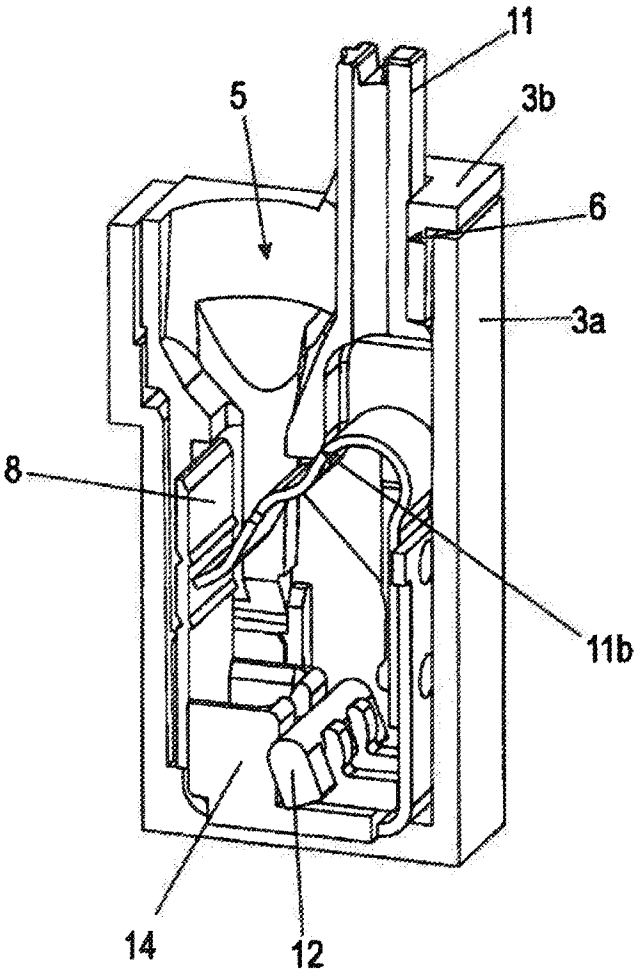
FIG. 3*a* is a perspective interior view of the spring terminal of FIGS. 1*a* and *b* and 2*a* and *b* in the state from FIG. 1*a;*
Figure 3C:
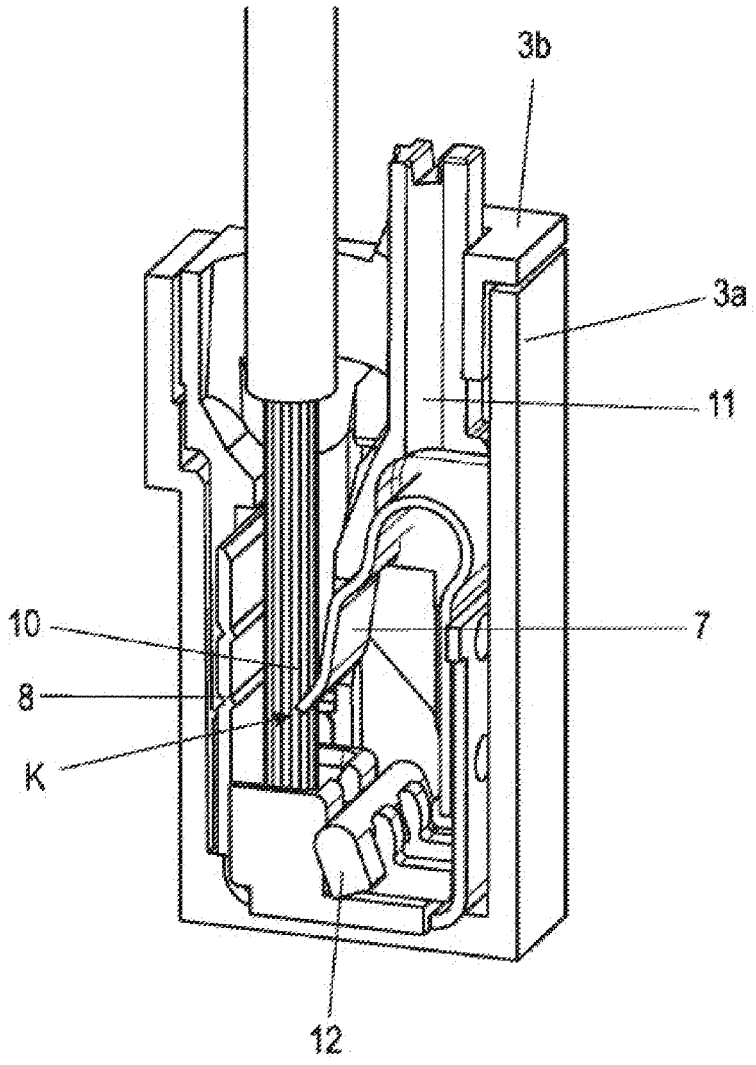
FIG. 3*c* is a perspective interior view of the spring force terminal from FIGS. 3*a* and 3*b* having an electrical conductor inserted into the spring force terminal, wherein the clamping leg is unlatched from the latching state.

According to FIGS. 1*a* to 3*c*, a metallic assembly is provided, which has a simply designed clamping cage 13 shown in FIGS. 1*a* and 2*a*, into which the clamping spring 7 is insertable. The clamping cage 13 is at least U-shaped in a side view and has three legs 13*a*, 13*b*, 13*c*. It is laterally open, which is not problematic, however, since the housing lower part 3*a* centers the conductor 10 at this location.

The clamping spring 7 is placed between the legs 13*a*, 13*b*, 13*c*. At least one of the legs 13*a*, 13*b*, 13*c* can be used for the connection to an electrical assembly (not shown), for example, to the connection to a plug (not shown) or to a circuit board or the like. The busbar 8 is constructed similarly to the clamping cage, in particular to the clamping cage leg 13*a*.

The clamping cage 13 is insertable with the clamping spring 7 from an open side into the housing lower part 3*a*. These elements are pre-installable on one another in this way, are thus easily further installable, and are located well protected in the housing lower part 3*a*.

In any case, the one leg 13*a* of the clamping cage 13 is formed by the busbar 8, which firstly extends in this section in parallel to the conductor plug-in direction X, then extends adjoining below the actual contact section to a clamping point K in a transverse leg 13*b* transverse to the conductor plug-in direction X, and then extends against the conductor plug-in direction X in a leg 13*c* again extending in parallel to the conductor plug-in opening X.

The clamping spring 7 is formed U-shaped or V-shaped and has a support leg 7*a* and a clamping leg 7*b*. The support leg 7*a* is supported on a buttress. This buttress can be formed by a projection on a wall of the chamber 4. It is formed here by the leg 13*c* of the busbar 8.

The clamping leg 7*b* is connected via a curved back 7*c* to the support leg 7*a*. The back 7*c* can overlap a support contour of the housing 3, which protrudes into the chamber 4, but is not required.

The pivotable clamping leg 7*b* is used to act on the respective conductor 10 with spring force in the region of the clamping point K (FIG. 2*b*) using a clamping edge 7*d* on its end, and to press this conductor 10 or its stripped conductor end against the busbar 8. An electrically conductive contact is produced in this way between the inserted conductor 10 and the busbar 8. This is apparent from FIG. 1*b*.

The conductor 10 can be guided in the conductor plug-in direction X through the conductor plug-in channel 5 into the chamber 4 in the region of the clamping point K (see FIGS. 2*a* and 4*a*).

An actuating element is arranged in the actuating channel 6. The actuating element is formed as a pressure element—referred to in short as pusher 11—which is displaceably guided in the actuating channel 6.

A free end 11*a* of the pusher 11 preferably protrudes outward beyond the outer side of the housing 3, so that it is well accessible. This is advantageous but not required. Furthermore, an actuating contour—in particular a depression 11*d*—for applying a tool, in particular a screwdriver, to the pusher 11 can be formed on this free end 11*a*. This depression 11*d* is preferably dimensioned in such a way that a screwdriver is insertable relatively solidly and far into the depression 11*d* as shown in FIGS. 4*b* and 4*c*. The upper actuation end of the pusher 11 can also be located inside the actuating channel 6, however.

The other end 11*c* of the pusher 11—facing away from the actuating end—protrudes up into the chamber 4. It is located in the lower half of this chamber. The pusher 11 furthermore has a pressure contour 11*b* between its two ends 11*a* and 11*c*. This pressure contour 11*b* is used to exert a force on the clamping leg 7*b* in the plug-in direction using the pusher 11 in order to open the clamping leg 7*b*.

Below the first pressure contour 11*b*, the pusher 11 has a slot 11*e* like a passage opening or a lower aperture having lateral walls as shown in FIGS. 4*b* and 4*c*.

In the installed state, the clamping leg 7*b* penetrates the slot 11*e* and can be pivoted to a limited extent inside the slot 11*e*.

The pusher 11 moreover has an actuating contour 11*f* for the action of a release element 12 still to be described.

Figure 4:
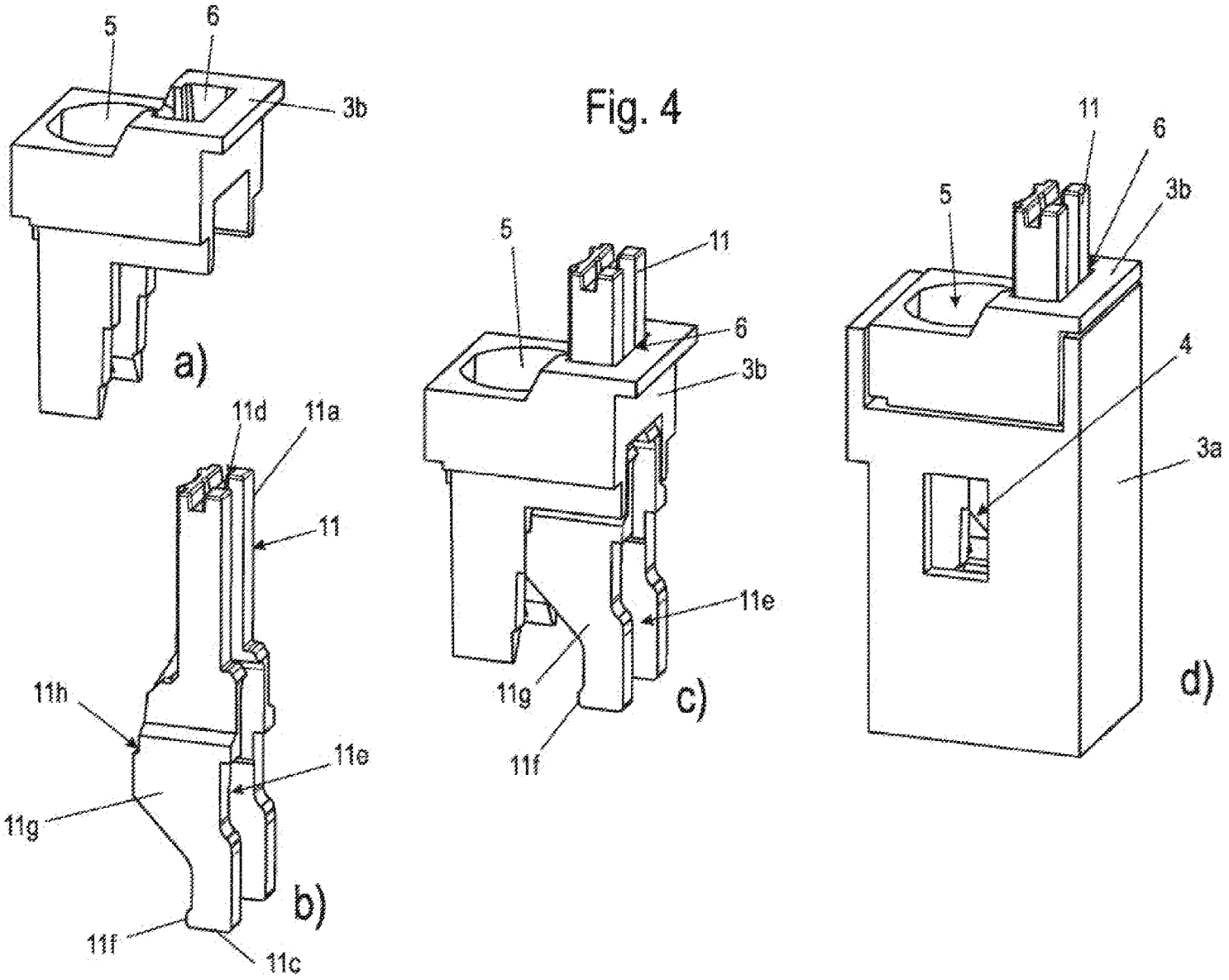
FIGS. 4*a*-4*j* are perspective views, respectively, of several components and component assemblies of the spring terminals from FIGS. 1 to 3.
Figure 4:
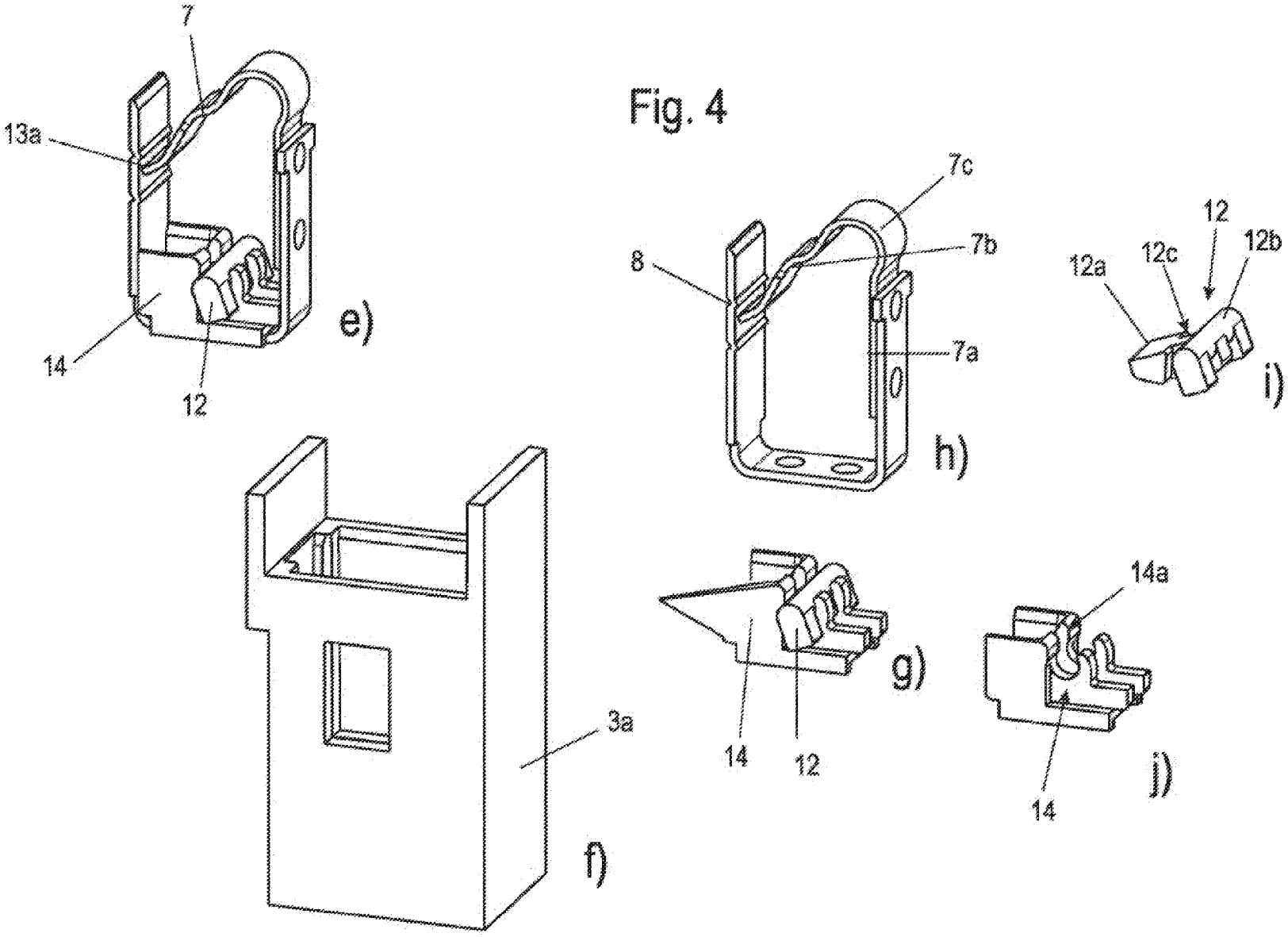

Laterally to the slot 11*e*, the pusher has one or two arms 11*g* also shown in FIG. 4 at the lower end of which the actuating contour 11*f* is formed in each case for the release element 12 still to be described.

The pusher has the pressure contour 11*b* between the arms 11*g* at the upper edge of the slot 11*e*, wherein pressure can be exerted on the clamping leg 7*b* using the pressure contour 11*b* in order to be able to insert pressure on the clamping leg 7*b* as the pusher 11 is pressed down into the actuating channel 6 in the conductor insertion direction X using the pressure contour 11*h* or the pressure edge, in order to pivot this clamping leg and space it apart from the busbar 8, so that a conductor 10 is insertable into the open clamping point K.

The arms 11*g* of the pusher 11 extend laterally to the clamping spring 7. In this way, reliable triggering on the two arms 11*g* of the pusher 11 is implementable. This action in turn moves the pusher 11, which is supported in a latched manner on the housing 3, so that it releases from latching on the latching edge 31, whereby the pusher 11 is released and slides somewhat upward in the actuating channel 6 again opposite to the plug-in direction X due to the spring force of the released clamping leg 7*b*.

This at least one actuating contour 11*f* is provided close to the end 11*c* of the pusher 11 in the chamber 4. It is located below the clamping point K.

A movable release element 12 is arranged in the chamber 4 laterally adjacent to the end 11*c* of the pusher 11 or above the end of the pusher—laterally to the actuating contour 11*f* in relation to a latching state still to be explained having a maximally inserted pusher 11.

This release element 12 is formed in an advantageous—but not required—design as a tilt lever, which has two lever arms 12*a*, 12*b* rotatable around an axis of rotation (see also FIGS. 4*e*, 4*g*, 4*i*, and 4*j*). The tilt lever 12 can be formed as an angled lever. It can be mounted in a bearing housing 14 or on a bearing block or the like, which is inserted into the chamber 4, for example, together with the busbar 8 and/or the clamping cage 13. For this purpose, the tilt lever 12 can have an axis 12*c*, which is pivotably inserted into a bearing recess 14*a* of the bearing block 14. The lever arm 12*a* is used for actuation by the conductor by pressing down into the chamber 4 and the lever arm 12*b* is used for moving the pusher 11 for the release from the latching position.

The pusher 11 furthermore has at least one lateral step like an offset, on which a first latching edge 11*h* (see also FIGS. 4*b*, 5 and 6) is formed. This latching edge 11*h* interacts with a corresponding latching edge 31 on/in the chamber 4 of the housing 3. To form this latching edge 31, the housing 3, and particularly the housing upper part 3*b*, has a corresponding step.

In this case, the latching edge 11*h* is formed on the side of the pusher 11 facing toward the clamping leg 7*b*. This is advantageous but not required.

By pressing the pusher 11 into the actuating channel 6 in the plug-in direction X, pressure can be exerted on the clamping leg 7*b* via the pressure contour 11*b*.

On the one hand, this is used to open the clamping point K with inserted conductor in order to be able to remove the conductor 10.

Figure 5A:
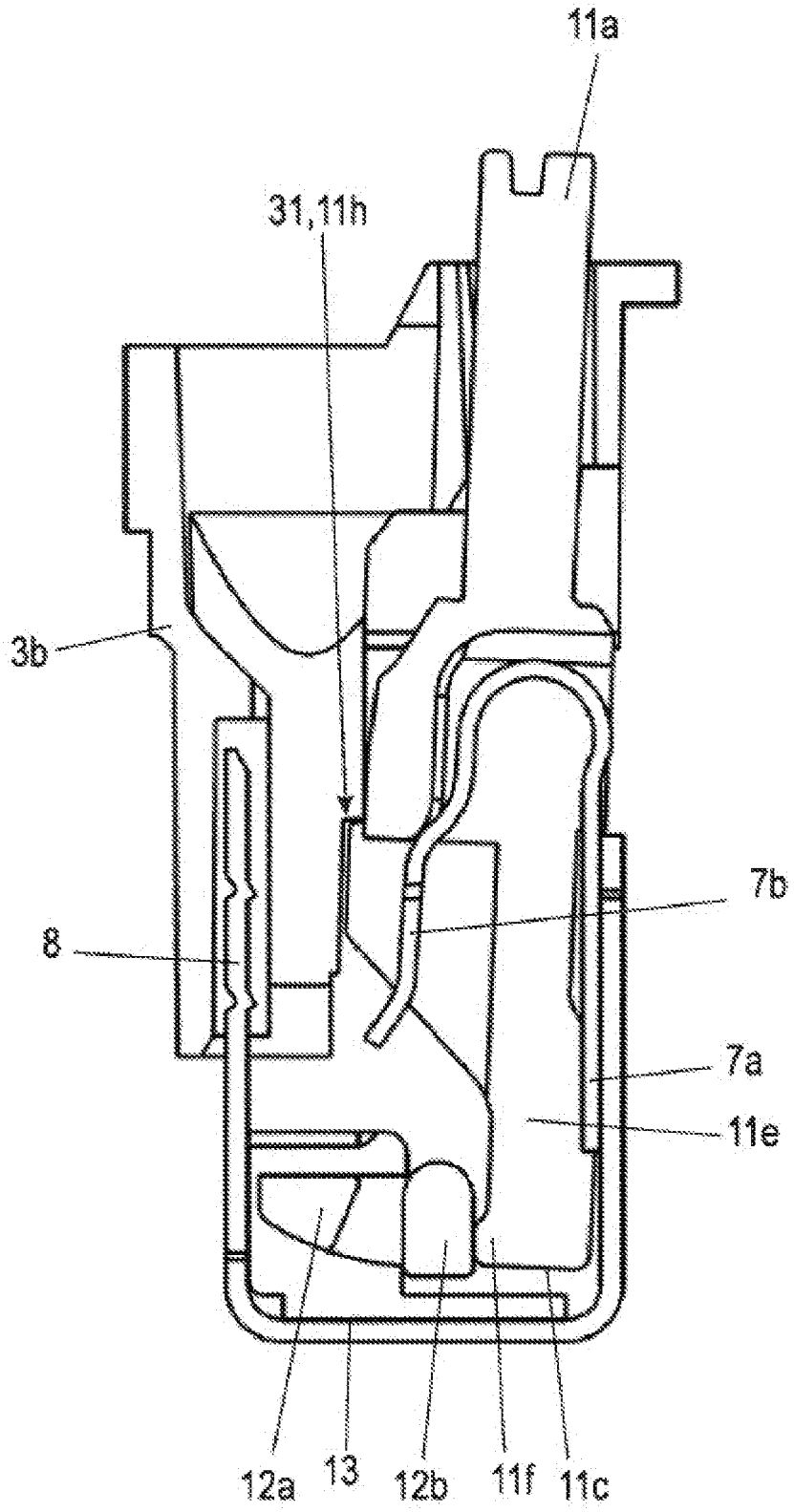
FIG. 5*a* is an interior side view of a spring force terminal as in FIG. 1 in an assembled latching state as in FIG. 3*b* but without a housing lower part.
Figure 5B:
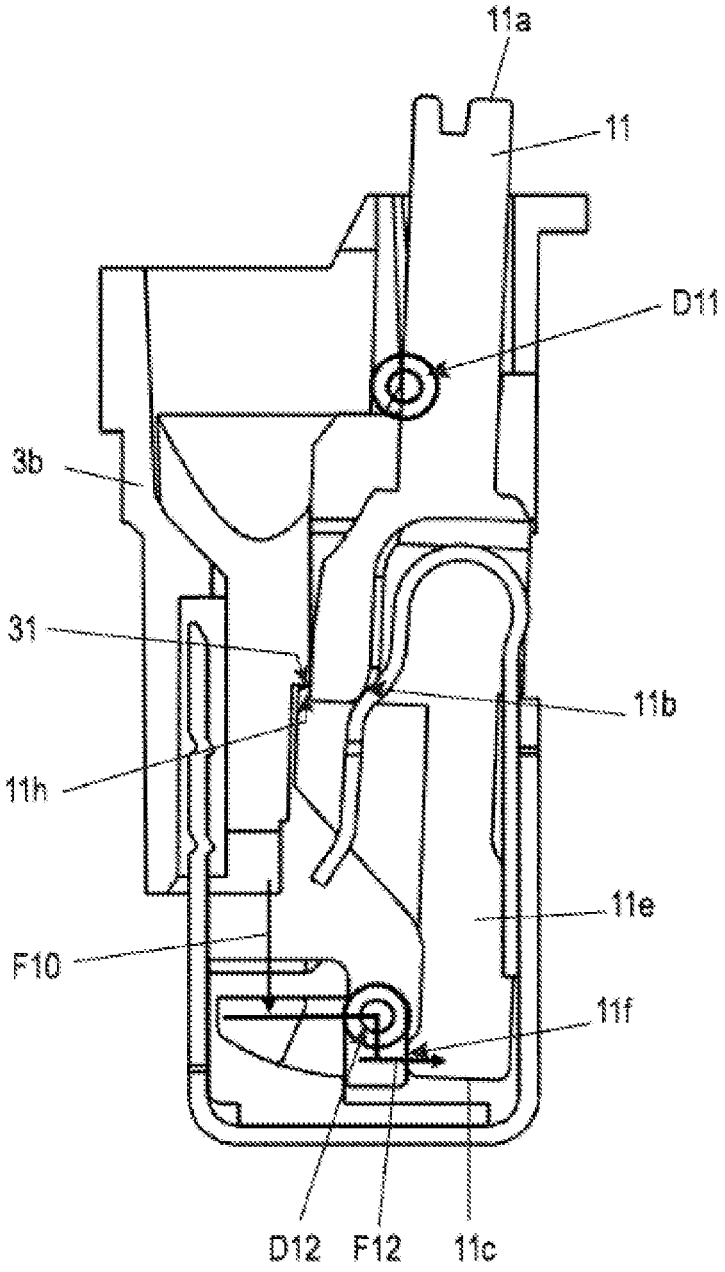
FIG. 5*b* is an interior side view of a spring force terminal as in FIG. 5*a* but supplemented with several force arrows and several axes of rotation.

However, starting from the position of FIG. 1*a*, the function of the pusher 11 is initially different. As soon as the pusher 11 or its latching edge 11*h* has been pressed deep enough in the conductor insertion direction X that it passes the corresponding oppositely oriented latching edge 31 of the housing 3—in the transition region from the actuating channel 6 to the chamber 4—the pusher 11 is pushed and/or pivoted to the side somewhat perpendicular to the plug-in direction X for the conductor 10 by the force of the clamping spring 7 or the clamping leg 7*b*. At the same time, the latching edge 11*h* of the pusher 11 latches behind the corresponding latching edge 31 of the housing 3 as shown in FIGS. 5*a* and 5*b*. The latching edge 31 or step of the housing 3 is located on the housing upper part 3*b* (FIG. 5*b*).

It is thus necessary that the pusher 11 is displaceable and/or pivotable to a limited extent transversely to the plug-in direction somewhat in the housing 3 or in the actuating channel 6. This ability to be displaced and/or pivoted is preferably at least dimensioned in such a way that the latching edge 11*h* can be moved during pressing of the pusher 11 in the above-described latching position (see in particular FIG. 5 and the pivot axis D11 in this regard). The pivot axis D11 is the axis around which the pusher rotates upon the superimposed pivot and linear movement during the release from the latching position when the release element acts thereon (identified as D11). This pivot axis D11 is located inside the actuating channel 6. For this purpose, the actuating channel 6 does not have a cylindrical profile but rather a profile initially tapering slightly conically in the conductor insertion direction X and then widening again, wherein the axis of rotation D11 can be formed by applying the pusher 11 to the transition region between the tapering and then widening region of the actuating channel 6 in the housing 3.

In this way, the clamping spring 7 or its clamping leg 7*b* also can be latched or is latched indirectly in an open position in the housing 3 via latching of the pusher as shown in FIGS. 1*b* and 2*a*.

This latching is performed by pressure on the clamping leg in the conductor insertion direction using the pusher 11, which is latched on the housing in a latching position, out of which it is also movable again, however, to release the latching of the pusher 11 and thus also that of the clamping spring 7.

In the latching position, the conductor 10 can be pushed in a simple manner up into the region of the clamping point K. Since the pusher 11 is latched, the clamping spring 7 or its clamping leg is held in an open position. A conductor end can thus be inserted. To contact it, the latching position has to be released. The release of the open position or the latching position of the clamping leg 7*b* is possible in two different ways.

Since the latching state is not produced by latching of an element on the free clamping edge 7*d*, i.e., that of the end of the latching leg 7*b* on which the conductor is to be clamped, only a very minor force is required for releasing the clamping leg from the latching position. The invention makes use of this in that it does not produce the latching position or the latching state on the free clamping edge 7*d* of the clamping leg 7*b* but rather by pressure of the pusher 11 on the clamping leg 7*b* in the conductor insertion direction spaced apart from the clamping edge more in the middle part of the clamping leg 7. In this case or in this way, even if the conductor 10 is formed, for example, as a very thin multi-strand conductor, using only a very minor force can be exerted on the release element 12, the pusher 11 can be used directly to release the clamping spring 7 or its clamping leg 7*b* from the latching position. The clamping spring 7 holds the pusher 11 in the latching position using its clamping leg 7*b*.

This is implementable in various ways with respect to the construction, thus expediently in the manner described hereinafter. Upon this actuation, the pusher 11 is moved, displaced, or pivoted somewhat in the housing 3 at its upper end to release the latching position—laterally perpendicular to the plug-in direction X—such that the latching edge 11*h* is moved out of the latching position on the latching edge 31 and the latching of the pusher 11 on the housing 3 is released. The latching position of the latching leg 7*b* is thus also released. In this way, the clamping leg 7*b* of the clamping spring 7 can relax and press the conductor 10 in the clamping point K against the busbar 8. This is achieved manually or using a tool.

Figure 6:
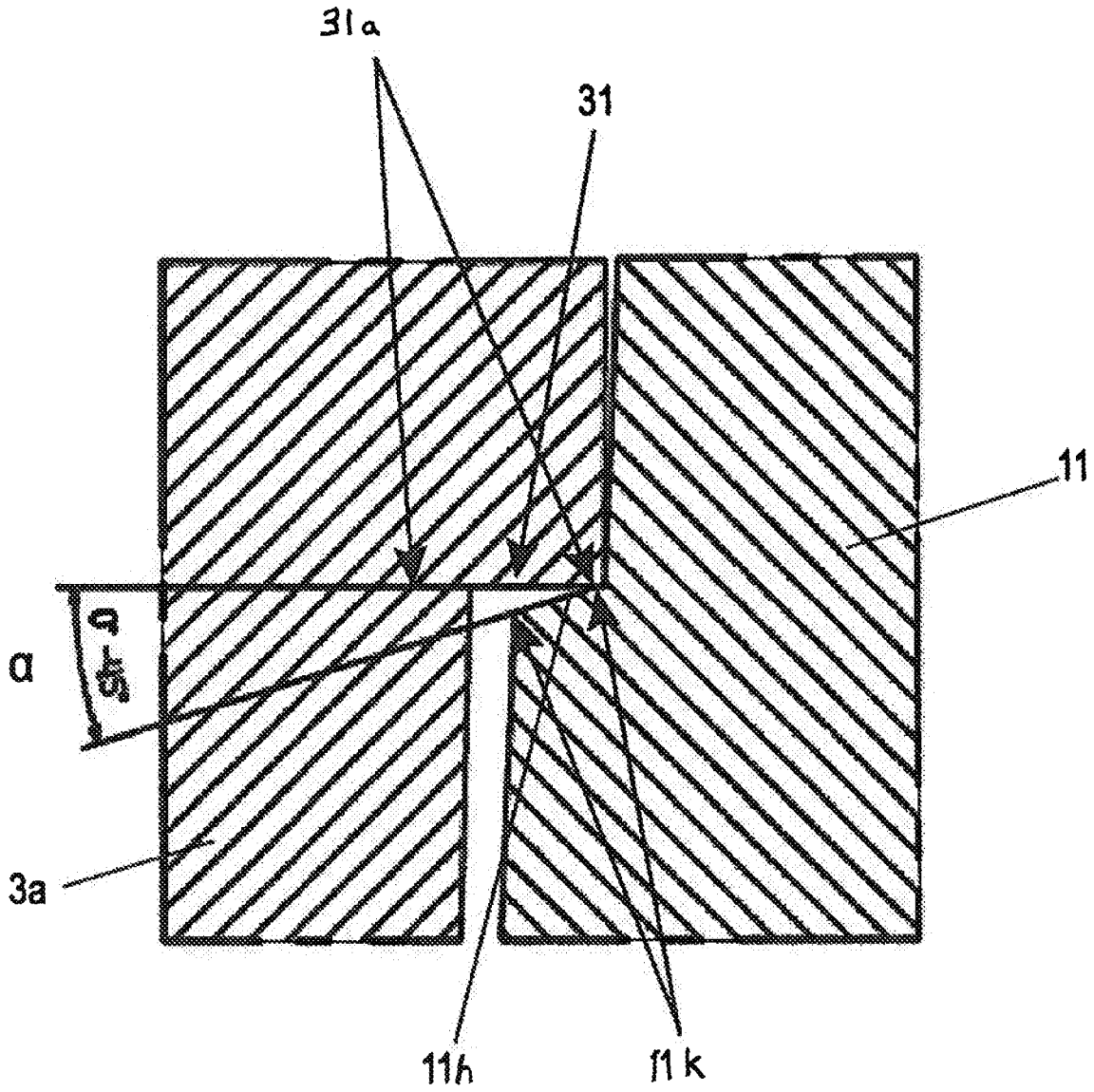
FIG. 6 is an enlarged side sectional view of a region of a latching edge between the housing and the pusher in the latching state.

This region can be seen more precisely in FIG. 6. Radii are advantageously formed on the corner regions or edge regions 31*a* and 11*k* in the region of the corresponding latching edge faces of the steps or latching edges 31 and 11*h*, which are not excessively small, so that the pusher 11 is releasable from the housing. The radii can preferably be in a range between 0.1 mm and 0.2 mm. Moreover, the latching edge faces which actually define the "latching edges" do not have to be aligned exactly in parallel to one another—which is also possible—but rather can preferably be aligned somewhat obliquely at an angle greater than 1° up to 45° in relation to one another, such that self-inhibiting locking is achieved, but possibly also such self-inhibiting locking which is easier to release than one having parallel surfaces and/or very small edge radii in the region of the latching edge faces.

Alternatively, a force F10 can be exerted on the release element 12 using the end of the conductor 10 in the conductor insertion direction X to release the pusher 11 from the open position and thus from the latching position. The conductor 10 presses in this case on one of the two lever arms, namely the lever arm 12*a*. In this way, the release element rotates around its axis of rotation 12*c* and the other lever arm 12*b* acts with a force F12 on the actuating contour 11*f* of the pusher 11. This action in turn moves the pusher 11, which is supported on the housing 3, in such a way that it releases from the latching on the latching edge 31, whereby the pusher 11 is released and again slides somewhat upward in actuating channel 6 against the plug-in direction X due to the force of the released clamping leg 7*b*.

This release of the latching position using the conductor end is the typical way to switch the spring force terminal 1. The above-described movement of the pusher 11 is an alternative solution if, for example, the conductor 10 is so flexible that sufficient force for actuating the release element 12 cannot be generated using it in the specific case.

It is advantageous if the depression 11*d* on the end 11*a* of the pusher 11 protruding from the housing 4 is dimensioned sufficiently deep that a force can be exerted on the pusher 11 by hand or preferably using an inserted screwdriver or another tool to release it from its latching position.

The pusher 11 can also have a step, which corresponds with a step of the actuating channel 6 and implements an insertion delimitation for the pusher 11 in the conductor plug-in direction X (not visible).

According to FIG. 4, the release element 12 is formed from a supplementary subassembly to the assembly of the elements 13 and 7. This subassembly can consist solely of metal, solely of plastic, or in a mixed form of elements made of metal and plastic. It has the release element 12 and the bearing block or a bearing housing 14 on which the release element 12 is pivotably mounted. This subassembly is also pre-installable on the clamping cage 13 and is insertable jointly with it and the busbar 7 into the housing 3.

The bearing block 14 can be formed as an element separate from the clamping cage 13 made of metal or plastic, which is fastenable on the clamping cage 13 (FIGS. 4*e*, 4*g*, 4*i*, and 4*j*) and again has receptacles for the release element 12. However, it can alternatively be formed by attachments on the busbar.

The release element 12 has two lever arms 12*a*, 12*b*. Therefore, a force can be exerted on the release element 12 using the conductor end of the conductor 10 in the conductor insertion direction X to release the pusher 11 from the open position and thus from the latching position. The conductor 10 presses on one of the two lever arms, namely the lever arm 12*a*. In this way, the release element 12 rotates around its axis of rotation 12*c* and the other lever arm 12*b* acts as a trigger contour on one or two corresponding actuating contour(s) 11*f* of the pusher 11.

The one or more actuating contours of the release element 12 preferably act perpendicularly or essentially perpendicularly (90° plus/minus 30°) on the pusher 11.

A release of the pusher 11 and the clamping spring using particularly small forces is possible in this way. The triggering reliability with respect to triggering by insertion of a conductor into the clamping point is again increased in a simple manner in this way.

Alternatively, the pusher 11 can be released directly from the latching position by actuation at its upper end, as described above.

The rotational directions of the pusher 11 and the release element 12 upon the release of the pusher 11 from the latching state are preferably the same. This can be seen well in FIG. 5. This is because the axes of rotation D11 and D12 of the pusher 11 and the release element 12 are shown in FIG. 5.

The axis of rotation D11 of the pusher 11 is located in front of the latching edge of the pusher 11 in the conductor insertion direction X. It is located above the clamping leg 7*b* of the clamping spring 7 (i.e., in front of the clamping spring 7 in the insertion direction X).

The one or more actuating contours 11*f*, in contrast, are preferably located at the height of or better below the axis of rotation of the release element 12 (i.e., behind the axis of rotation D12 in the insertion direction X).

A more compact structure can be achieved in this way and it is possible in a simple manner to constructively implement the above-explained alignment of the force action of the release element 12 perpendicularly or essentially perpendicularly to the lever arm of the release element.

It is also conceivable to optionally provide an additional element, in particular a sliding element, for deflecting the conductor plug-in force in the direction of the trigger force (not shown).

Figure 7:
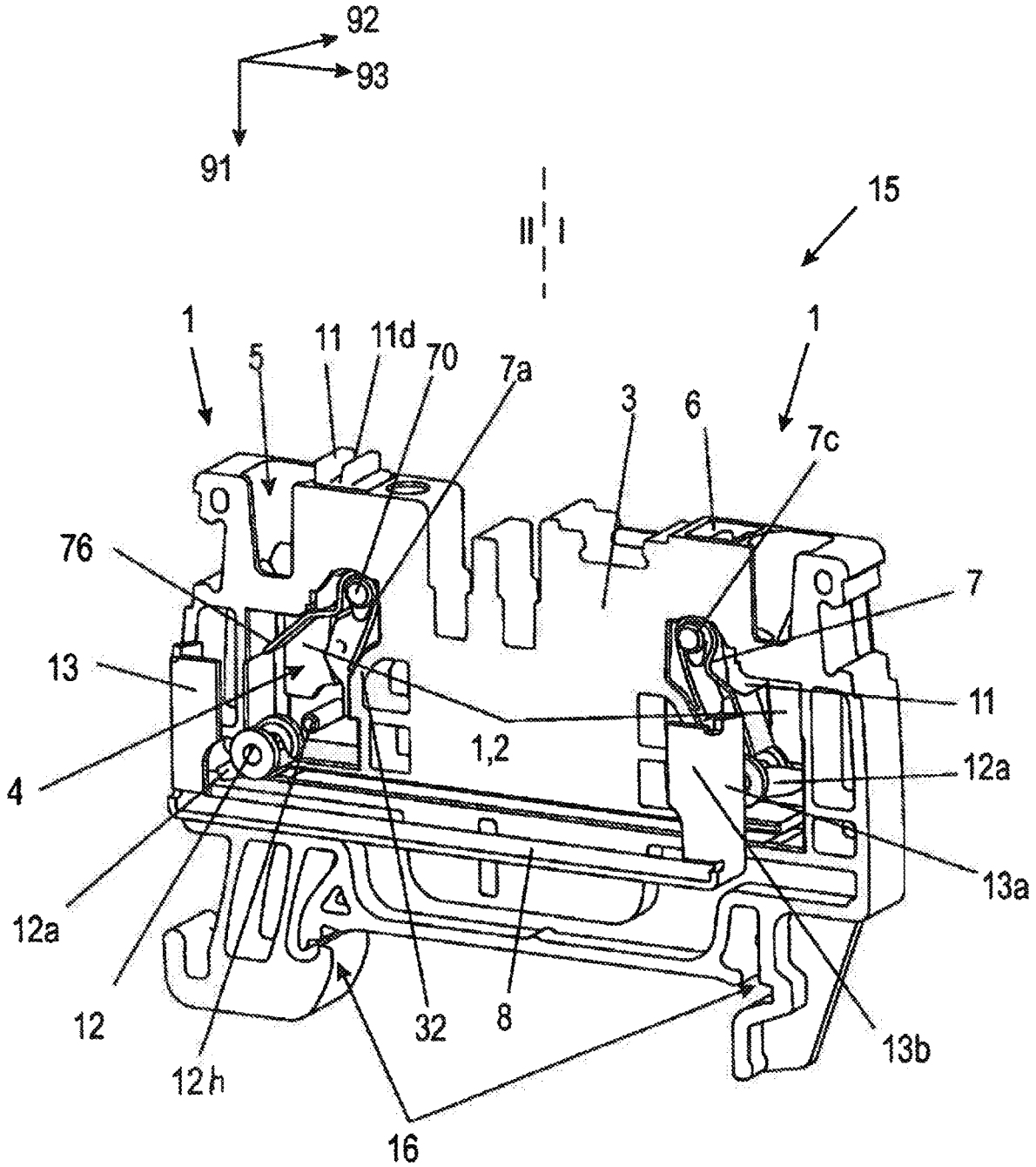
FIG. 7 is a perspective view of a terminal block having two spring force terminals according to the invention.

FIG. 7 shows a terminal block 15 having two spring force terminals 1 according to the invention in a perspective view. The terminal block 15 has an electrically insulating housing 3, which is preferably open on one side in the stacking direction, and which encloses the spring force terminals 1 and is lockable on a top-hat rail 160 as shown in FIG. 9. The housing 3 has a locking device 16 for locking on the top-hat rail 160.

The spring force terminals 1 are arranged in a transverse direction 93 transversely to the plug-in direction 91 and also transversely to a stacking direction 92 on opposing sides I, II of the terminal block 15.

The spring force terminals 1 each have a chamber, in each of which the clamping spring is arranged. The back 7*c* of the clamping spring 7 wraps around a part of the web 70, which forms the pivot axis for the clamping leg 7*b* of the clamping spring 7. The support leg 7*a* of the clamping spring 7 is supported during pivoting of the clamping leg 7*b* around the pivot axis on a support contour 32 of the housing 3.

Each of the spring force terminals 1 has a pusher 11. It is arranged in the actuating channel 6. The clamping leg 7*b* penetrates the slot 11*e* of the pusher. It is pivotable at least to a limited extent inside the slot 11*e*. To actuate the clamping leg 7*b*, the pusher 11 has the pressure contour 11*b* (see FIG. 10*a*) which can exert pressure on the clamping leg 7*b*.

Figure 10:
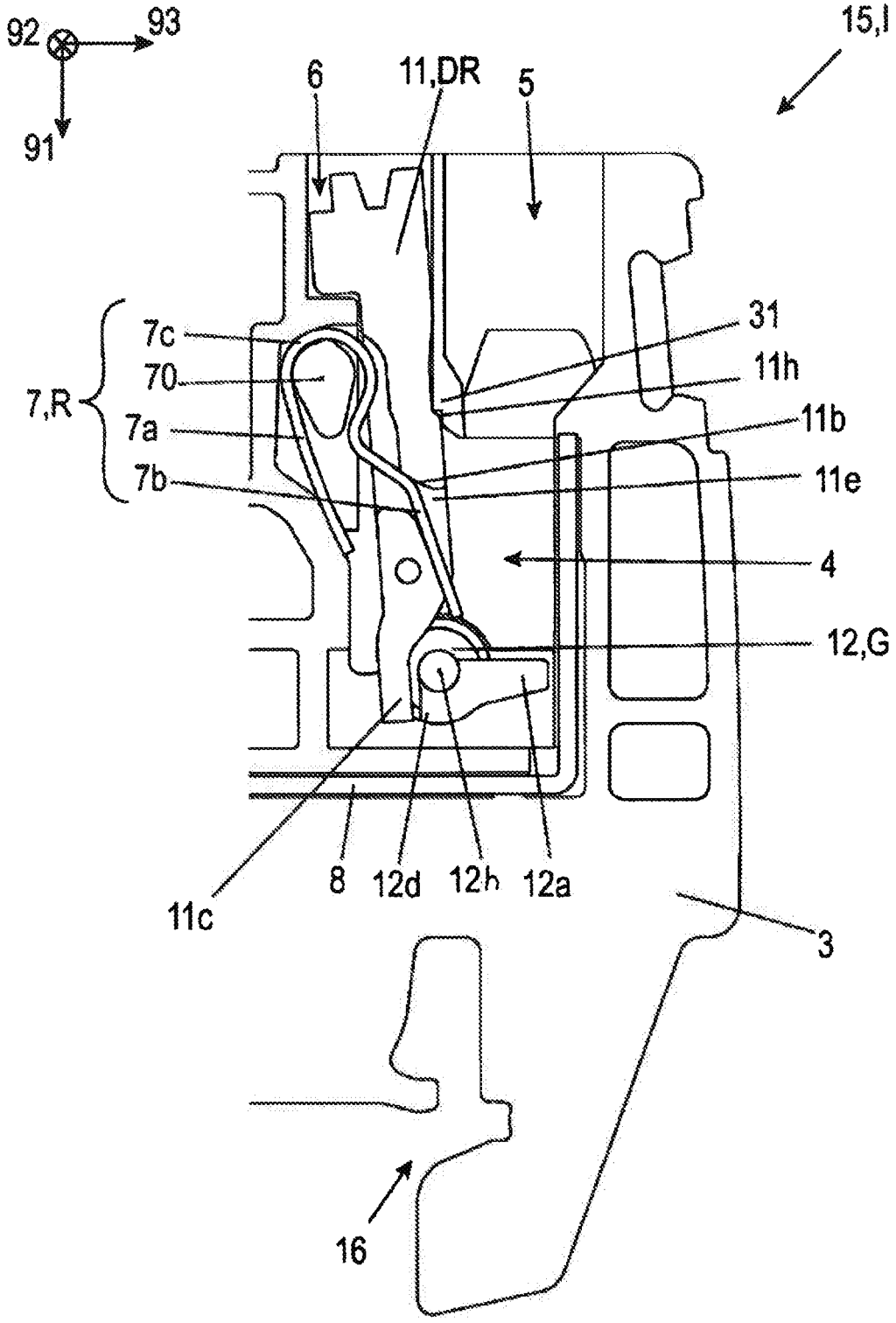
FIGS. 10*a*-10*d* are partial interior views of the terminal block of FIG. 7 showing the spring force terminal in various states, respectively.
Figure 10:
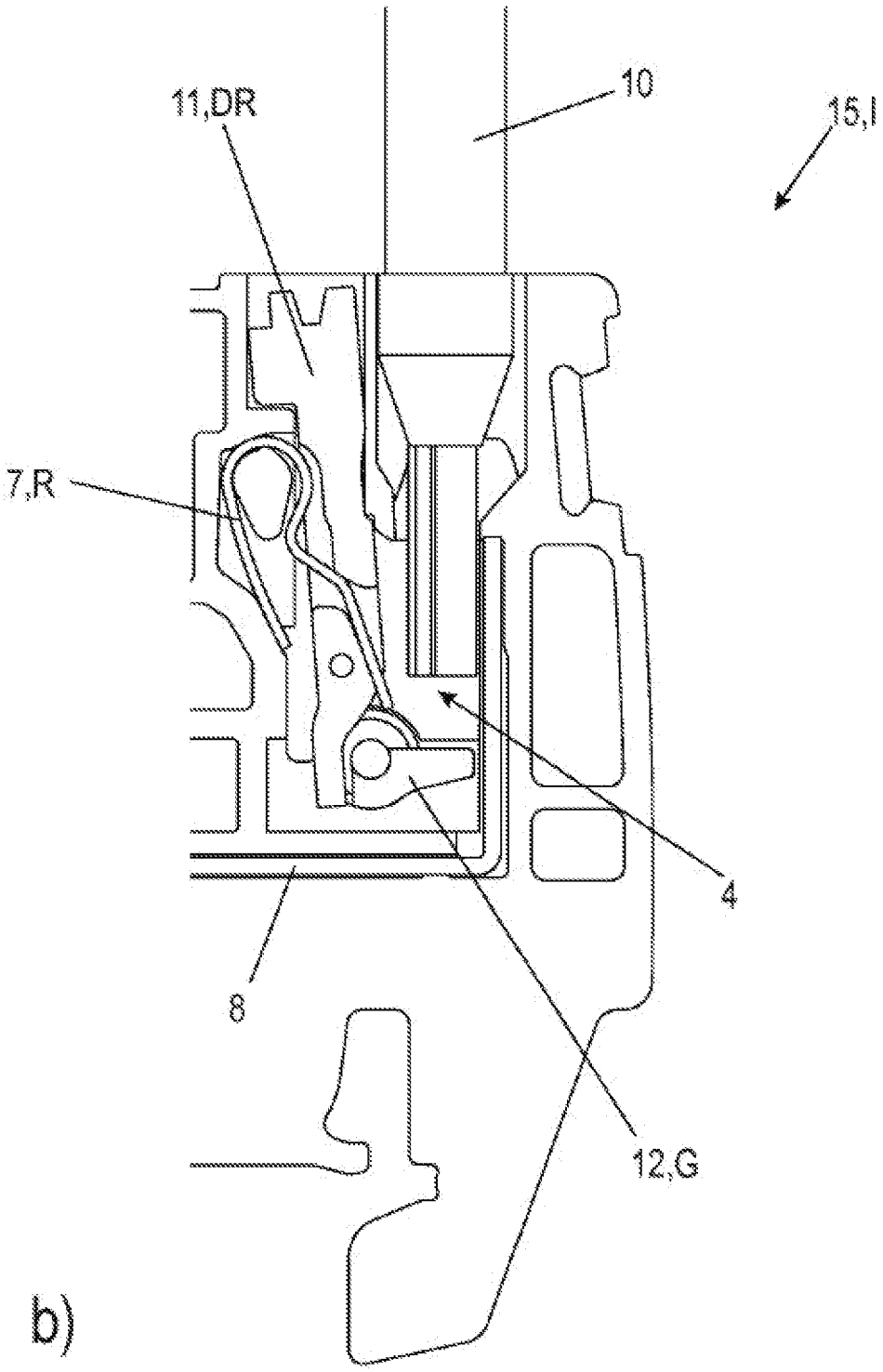
Figure 10:
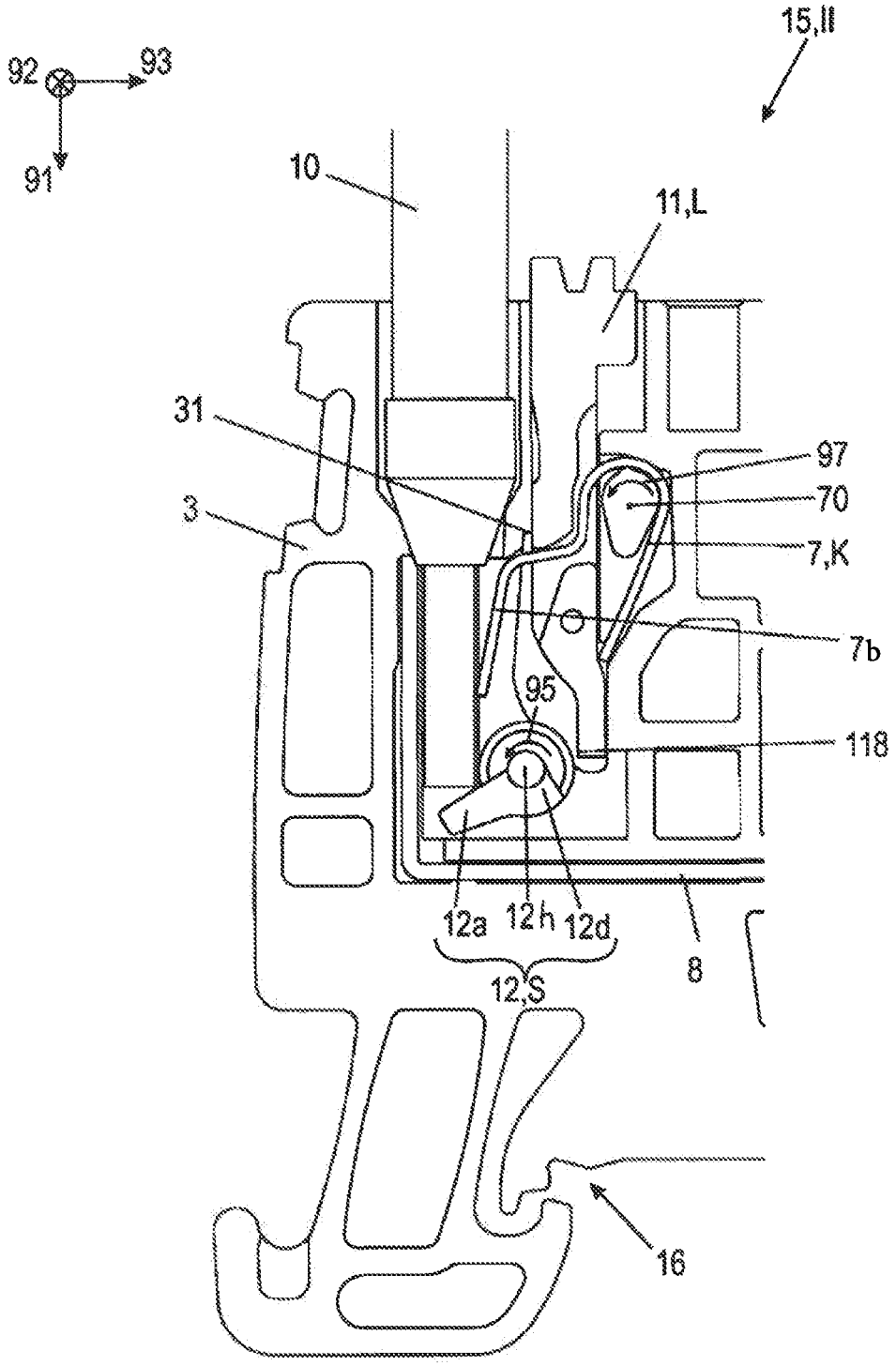
Figure 10:
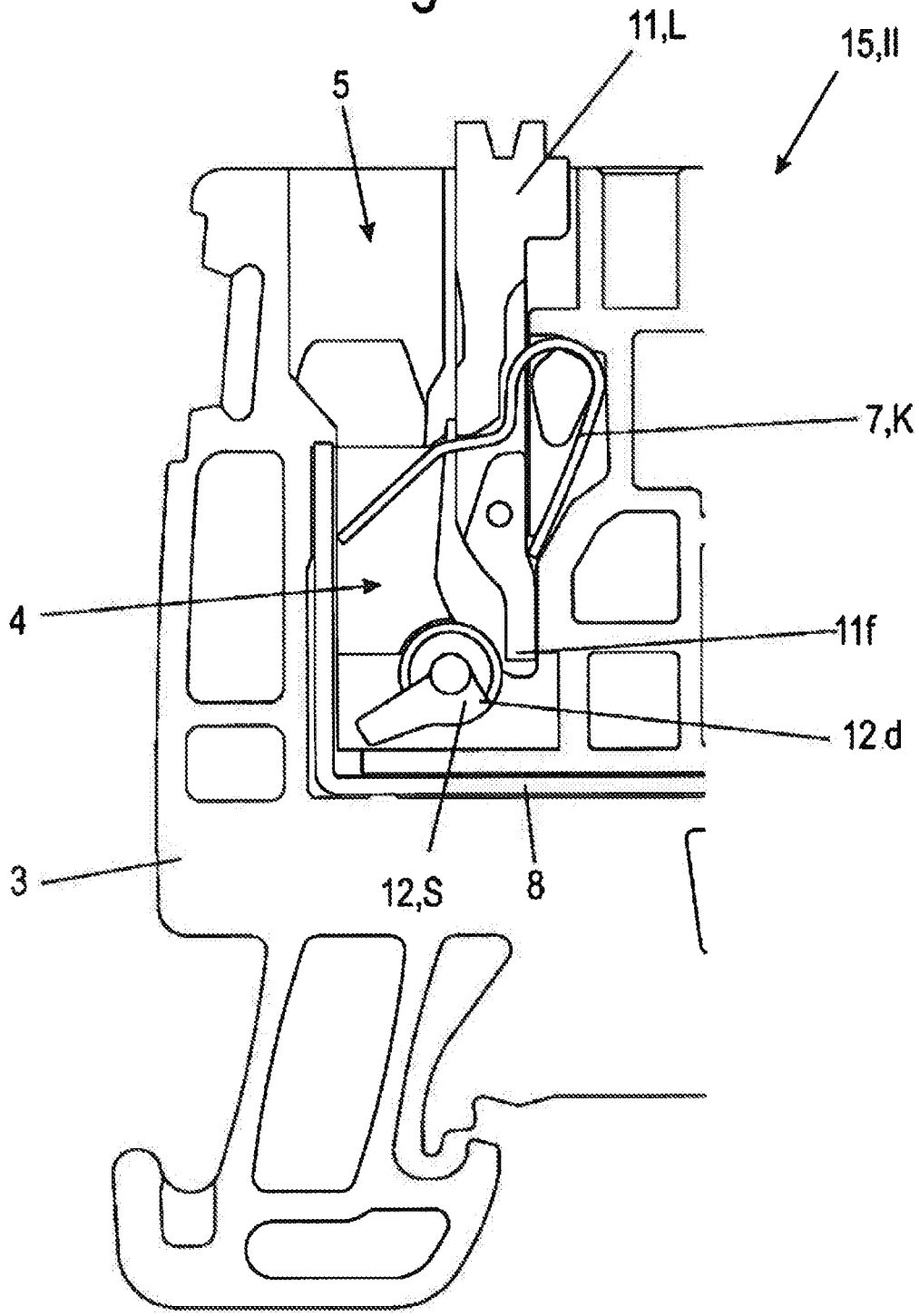

The pusher 11 moreover has the actuating contour 11*f* to act on the release element 12 as shown in FIG. 10*c*.

Figure 8:
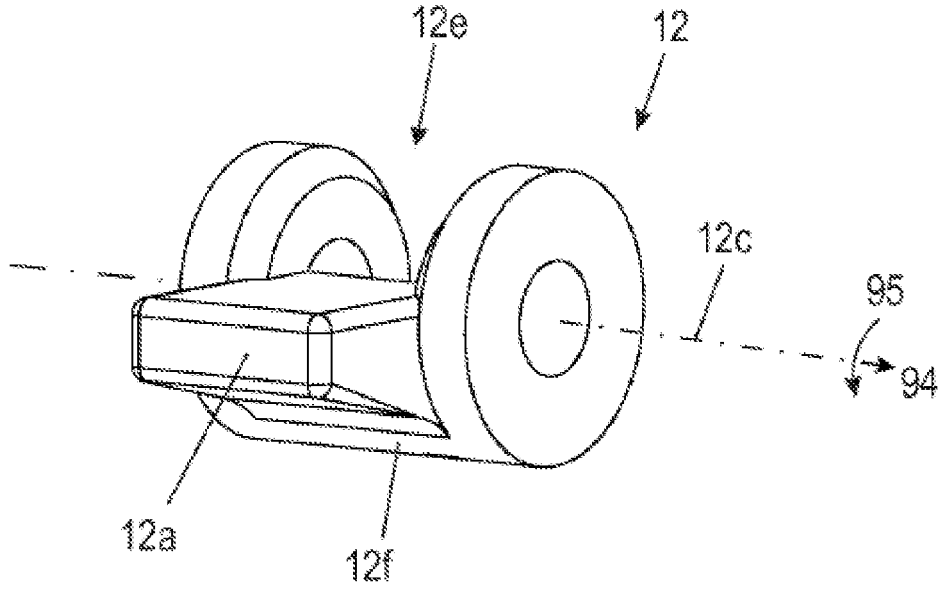
FIGS. 8*a* and 8*b* are perspective views, respectively, of a release element for the spring force terminals of the terminal block from FIG. 7.
Figure 8:
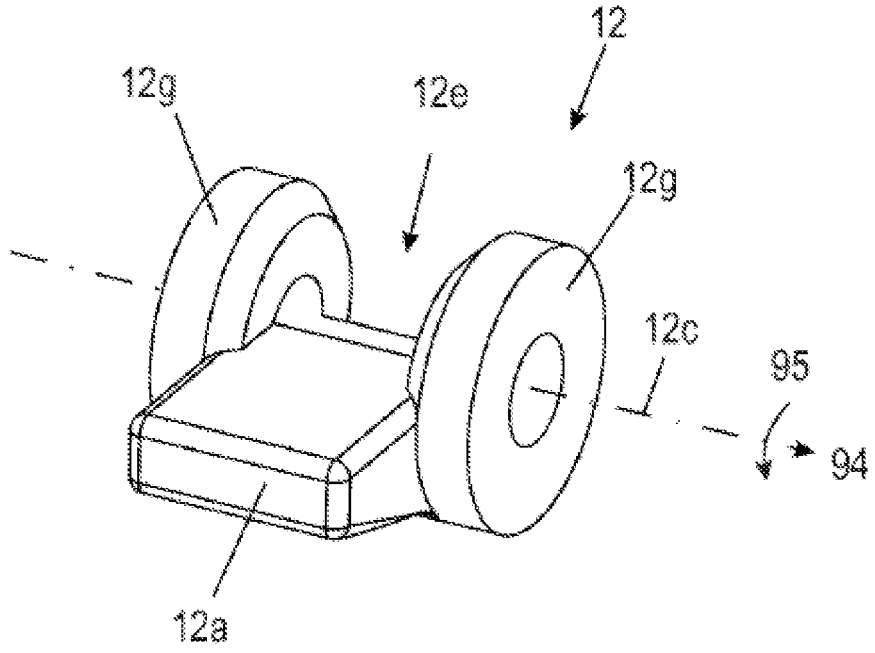

The release element 12 is rotatably arranged around a rotation pin 12*h*, which forms the axis of rotation. It is described in greater detail in the scope of FIG. 8. The release element 12 of the spring force terminal 1 arranged on the second side of the terminal block 15, on the left in the plane of the image, is shown presented in an exploded view and can be pushed onto its rotation pin 12*h* by displacement in the stacking direction 92.

Moreover, the spring force terminals 1 of the terminal block 15 each have a clamping cage 13 having two legs 13*a*, 13*b* arranged transversely in relation to one another. The clamping cages 13 of the terminal block 15 are connected to one another by a busbar 8. The clamping cages 13 and the busbar 8 connecting them to one another are also shown in an exploded view and are insertable into the terminal block 15 by displacement in the stacking direction 92.

An electrical conductor 10 can be plugged into each of the spring force terminals 1 through the conductor plug-in channel 5 in the plug-in direction 91. FIG. 9 shows the spring force terminals 1 having plugged-in conductor 10.

In the spring force terminal 1 arranged on the first side I, on the right in the plane of the image, the pusher 11 is latched with its latching edge 11*h* (see FIG. 10*a*) on the latching edge 31 of the housing 3 in the latching state DR. The clamping spring 7 is thus located in the latching state R, in which the clamping leg 7*b* releases the chamber 4 and it is therefore open for the insertion of the electrical conductor 10. FIG. 10*a* also shows this state.

In contrast, in the spring force terminal 1 arranged on the second side II, on the left in the plane of the image, the pusher 11 is located in a released, unlatched position L. In this position, the pusher 11 is displaced upward in relation to the latching position DR against the plug-in direction 91. The clamping leg 7*b* is located in the closed position K, in which it penetrates the chamber 4. FIG. 10*d* also shows this state.

FIGS. 8*a* and 8*b* show the release element 12 for the spring force terminals 1 of this terminal block 15 in two perspective views. The release element has a hollow cylindrical body 12*f*, which has a wheel-shaped expansion 12*g* on each opposing end. The hollow cylindrical body 12*f* can be pushed onto the rotation pin 12*h* forming the axis of rotation. A lever arm 12*a*, which is actuatable using the electrical conductor 10 plugged into the spring force terminal 1, is arranged on the release element 12. An intermediate space 12*e*, into which the end 11*c* of the pusher 11 is insertable, is formed between the expansions 12*g*. Starting from an open actuation end (not shown) in the direction toward the hollow cylindrical body 12*f*, the lever arm 12*a* widens. Somewhat below the axis of rotation 12*c*, it has an actuating counter contour 12*d* (see FIG. 10*a*), which is provided to interact with an actuating contour 11*f* of the pusher 11. FIG. 9 shows a terminal block assembly 150 having a plurality of terminal blocks 15 according to FIG. 7 stacked on one another in the stacking direction 92. The terminal block assembly 150 is locked on a top-hat rail 160. An electrical conductor 10 is inserted into each of the spring force terminals 1.

In the spring force terminal 1 arranged on the first side I, on the right in the plane of the image, the electrical conductor 10 is not yet clamped. FIG. 10*b* also shows this state.

In the spring force terminal 1 arranged on the second side II, on the left in the plane of the image, the electrical conductor 10 is clamped. It actuates the release element 12. FIG. 10*c* also shows this state.

FIGS. 10*a*-10*d* show a detail from the terminal block 15 according to FIG. 7, wherein each of the details show the spring force terminal 1 in various states.

In FIG. 10*a*, the pusher is located in the latching state DR. The clamping spring 7 is thus also located in the latching state R and the clamping leg 7*b* is adjusted against its restoring force. The chamber 4 is thus open and an electrical conductor 10 is insertable into the spring force terminal 1. The release element 12 is located in the base position G, in which the lever arm 12*a* of the release element 12, which is provided to interact with the electrical conductor 10, extends in the transverse direction 93 transversely to the insertion direction 91. In this base position G, the actuating counter contour 12*d* is arranged below the rotation pin 12*h* forming the axis of rotation of the release element 12. The pusher 11 is thus positioned in the intermediate space 12*e* between the expansions 12*g* of the hollow cylindrical body 12*f* of the release element 12. This arrangement is very space-saving and the spring force terminal 1 can thus be constructed to be very small/narrow.

FIG. 10*b* shows the spring force terminal 1 during insertion of the electrical conductor 10 into the chamber 4. The electrical conductor 10 is not yet clamped.

In FIG. 10*c*, the electrical conductor 10 is inserted as far as possible into the chamber 4, so that it actuates the lever arm 12*a* of the release element 12 and it is pivoted in the rotational direction 95. The release element 12 is therefore located in a pivoted pivot position S. The pusher 11 is located in the released position L. It is displaced by the clamping leg 7*b* using the restoring force of the clamping spring 7 against the plug-in direction 91. The clamping leg 7*b* presses the electrical conductor 10 against the clamping cage 13, so that it is clamped in the spring force terminal 1.

The actuating counter contour 12*d* is pivoted by the rotational angle (not shown) due to the pivoting of the release element 12. It is thus extended in relation to its position below the rotation pin 12*h*. The actuating counter contour 12*d* is thus easily accessible and actuatable for the actuating contour 11*f* of the pusher.

Starting from this state, the pusher 11 can be displaced easily in the plug-in direction 91 and slightly against the transverse direction 93 (perpendicular to the plug-in direction), so that the actuating contour 11*f* of the pusher 11 interacts with the actuating counter contour 12*d* of the release element 12, and the release element 12 is rotated back against the rotational direction 95. At the same time, the clamping leg 7*b* is pivoted against the restoring force of the clamping spring 7 in the pivot direction 97, so that it releases the electrical conductor 10. The conductor 10 can then be pulled out of the chamber 4 against the plug-in direction 91.

In order that another electrical conductor 10 is insertable into the chamber 4, the pusher 11 can now be locked again with its latching edge 11*h* on the latching edge 31 of the housing 3. The clamping spring 7 is then again located in the state of FIG. 10*a*.

The invention claimed is:

1. A spring force terminal for connecting a conductor, comprising (a) a housing containing a chamber, a plug-in channel connected with said chamber for receiving the conductor in a plug-in direction, an actuation channel, and a latching edge adjacent to said actuation channel;

(b) at least one of a busbar and a clamping cage;

(c) a clamping spring arranged in the chamber for pressing the conductor on the busbar or the clamping cage, said clamping spring including a clamping leg pivotable around a pivot axis between a latching state wherein said clamping leg is spaced from the conductor and a clamping state wherein said clamping leg presses the conductor on the busbar or the clamping cage; and (d) an actuation assembly operable to release said clamping leg from the latching state, said actuation assembly including (1) a pushing element displaceable in said actuation channel in the plug-in direction and including a latching edge which engages said housing latching edge to retain said clamping spring in the latching state; and (2) a release element arranged in said chamber and extending laterally in relation to said pushing element, said release element being operable to engage said pushing element in a direction perpendicular to said plug-in direction to release said pushing element from the latching state, wherein said latching edges of said pushing element and of said housing are formed as steps have rounded edges.

2. A spring force terminal for connecting a conductor, comprising (a) a housing containing a chamber, a plug-in channel connected with said chamber for receiving the conductor in a plug-in direction, an actuation channel, and a latching edge adjacent to said actuation channel;

(b) at least one of a busbar and a clamping cage;

(c) a clamping spring arranged in the chamber for pressing the conductor on the busbar or the clamping cage, said clamping spring including a clamping leg pivotable around a pivot axis between a latching state wherein said clamping leg is spaced from the conductor and a clamping state wherein said clamping leg presses the conductor on the busbar or the clamping cage; and (d) an actuation assembly operable to release said clamping leg from the latching state, said actuation assembly including (1) a pushing element displaceable in said actuation channel in the plug-in direction and including a latching edge which engages said housing latching edge to retain said clamping spring in the latching state; and (2) a release element arranged in said chamber and extending laterally in relation to said pushing element, said release element being operable to engage said pushing element in a direction perpendicular to said plug-in direction to release said pushing element from the latching state, and wherein said latching edges of said pushing element and of said housing are formed as steps which have corresponding latching edge faces which are aligned at an angle between 5 to 20° in relation to one another in the latching state.

3. A spring force terminal for connecting a conductor, comprising (a) a housing containing a chamber, a plug-in channel connected with said chamber for receiving the conductor in a plug-in direction, an actuation channel, and a latching edge adjacent to said actuation channel, said housing being laterally open and having a stackable configuration;

(b) at least one of a busbar and a clamping cage;

(c) a clamping spring arranged in the chamber for pressing the conductor on the busbar or the clamping cage, said clamping spring including a clamping leg pivotable around a pivot axis between a latching state wherein said clamping leg is spaced from the conductor and a clamping state wherein said clamping leg presses the conductor on the busbar or the clamping cage; and (d) an actuation assembly operable to release said clamping leg from the latching state, said actuation assembly including (1) a pushing element displaceable in said actuation channel in the plug-in direction and including a latching edge which engages said housing latching edge to retain said clamping spring in the latching state; and (2) a release element arranged in said chamber and extending laterally in relation to said pushing element, said release element being operable to engage said pushing element in a direction perpendicular to said plug-in direction to release said pushing element from the latching state.

* * * * *